US005892239A

United States Patent [19]

Nagase

[11] Patent Number: 5,892,239

[45] Date of Patent: Apr. 6, 1999

[54] BILL OR SECURITY DISCRIMINATING APPARATUS USING P-POLARIZED AND S-POLARIZED LIGHT

[75] Inventor: Mitsuhiro Nagase, Tokyo, Japan

[73] Assignee: Laurel Bank Machines Co., Ltd., Tokyo, Japan

[21] Appl. No.: 874,761

[22] Filed: Jun. 13, 1997

[30] Foreign Application Priority Data

Jun. 28, 1996 [JP] Japan ..... 8-170463
Jun. 12, 1997 [JP] Japan ..... 9-154662

[51] Int. Cl.[6] ..... G07D 7/00

[52] U.S. Cl. ..... 250/556; 250/225; 356/71; 356/369; 283/85; 283/90

[58] Field of Search ..... 250/556, 555, 250/221, 222.1, 225, 559.09, 559.04, 559.44; 283/72, 82, 83, 85, 90, 87, 901, 88, 89, 91; 162/140; 194/206, 207, 212; 356/71, 429, 445, 448, 364, 369, 365, 370, 366, 367

[56] References Cited

U.S. PATENT DOCUMENTS 4,544,836 10/1985 Galvin et al. ..... 235/487
4,896,901 1/1990 Ekelund ..... 283/90
4,980,569 12/1990 Crane et al. ..... 283/85
4,990,790 2/1991 Yoshihara ..... 250/225
5,345,308 9/1994 Rushman ..... 356/364
5,535,871 7/1996 Harbaugh ..... 194/206
5,543,608 8/1996 Rontalainen ..... 283/90

FOREIGN PATENT DOCUMENTS 6-215233 8/1994 Japan .

*Primary Examiner*—Edward P. Westin
*Assistant Examiner*—John R. Lee
*Attorney, Agent, or Firm*—Frishauf, Holtz, Goodman, Langer & Chick, P.C.

[57] ABSTRACT

A bill or security discriminating apparatus includes at least one irradiating device for irradiating a surface of a bill or security at a predetermined angle with the surface thereof, at least one polarization separating device for receiving light reflected by the surface of the bill or security and separating the received light into P-polarized light and S-polarized light, at least one first light detector for photoelectrically detecting the P-polarized light separated by the at least one polarization separating device and generating an electrical signal in accordance with intensity of the detected light, at least one second light detector for photoelectrically detecting the S-polarized light separated by the at least one polarization separating device and generating an electrical signal in accordance with intensity of the detected light, and a discriminator for discriminating the bill or security in accordance with the intensity of the P-polarized light and S-polarized light based on the electrical signals input from the at least one first light detector and the at least one second light detector. According to the thus constituted bill or security discriminating apparatus, it is possible to discriminate bills or securities with high accuracy even if they are damaged or wrinkled.

18 Claims, 5 Drawing Sheets

BILL OR SECURITY DISCRIMINATING APPARATUS USING P-POLARIZED AND S-POLARIZED LIGHT

BACKGROUND OF THE INVENTION

The present invention relates to a bill or security discriminating apparatus and, in particular, to a bill or security discriminating apparatus for wrinkled.

DESCRIPTION OF THE PRIOR ART

Recently, bills or securities such as gold notes formed with a line of resin, metal or the like called a security thread have been issued for preventing counterfeiting.

Japanese Patent Application Laid Open No. 6-215223 discloses a discriminating apparatus for discriminating the genuineness of bills formed with such a security thread. This discriminating apparatus is constituted so as to irradiate a security thread on a bill being transported along a transport passage with light from a light source, photoelectrically detect reflected light to produce an analog signal, compare digital data obtained by A/D converting the analog signal with reference data determined in advance and discriminate the bill.

However, when bills or securities are damaged or wrinkled, since the intensity of light reflected by the same type of security thread varies, it is difficult to discriminate bills or securities with high accuracy and the discrimination accuracy inevitably becomes lower.

SUMMARY OF THE INVENTION

It is therefore an object of the present invention to provide a bill or security discriminating apparatus for discriminating bills or securities with high accuracy even if they are damaged or wrinkled.

The above and other objects of the present invention can be accomplished by a bill or security discriminating apparatus comprising at least one irradiating means for irradiating a surface of a bill or security at a predetermined angle with the surface thereof, at least one polarization separating means for receiving light emitted from the irradiating means and reflected by the surface of the bill or security and separating the received light into P-polarized light and S-polarized light, at least one first light receiving means for photoelectrically detecting the P-polarized light separated by the at least one polarization separating means and generating an electrical signal in accordance with intensity of the detected light, at least one second light receiving means for photoelectrically detecting the S-polarized light separated by the at least one polarization separating means and generating an electrical signal in accordance with intensity of the detected light, and discriminating means for discriminating the bill or security in accordance with the intensity of the P-polarized light and S-polarized light based on the electrical signals input from the at least one first light receiving means and the at least one second light receiving means.

In a preferred aspect of the present invention, the discriminating means further includes at least one calculating means for calculating a ratio of intensity of the P-polarized light to that of the S-polarized light, a ratio of intensity of the S-polarized light to that of the P-polarized light or a difference between the P-polarized light and that of the S-polarized light and is constituted so as to discriminate the bill or security in accordance with the ratio of intensity of the P-polarized light to that of the S-polarized light, the ratio of intensity of the S-polarized light to that of the P-polarized light or the difference between the P-polarized light and that of the S-polarized light calculated by the calculating means.

In a further preferred aspect of the present invention, the predetermined angle is determined to be equal to or close to a polarizing angle of material forming the surface of the bill or security to be irradiated with light.

In a further preferred aspect of the present invention, the irradiating means includes a light source, a collimator lens and a slit plate formed with a slit.

In a further preferred aspect of the present invention, the at least one irradiating means, the at least one polarization separating means corresponding thereto, and the at least one first light receiving means and the at least one second light receiving means corresponding thereto are constituted so as to be synchronously movable.

In a further preferred aspect of the present invention, two of the irradiating means, the polarization separating means corresponding thereto, the first light receiving means and the second light receiving means corresponding thereto are respectively provided above and below the bill or security to be discriminated and four calculating means correspondingly are provided.

The above and other objects and features of the present invention will become apparent from the following description made with reference to the accompanying drawings.

DESCRIPTION OF THE PREFERRED EMBODIMENTS

Figure 1:
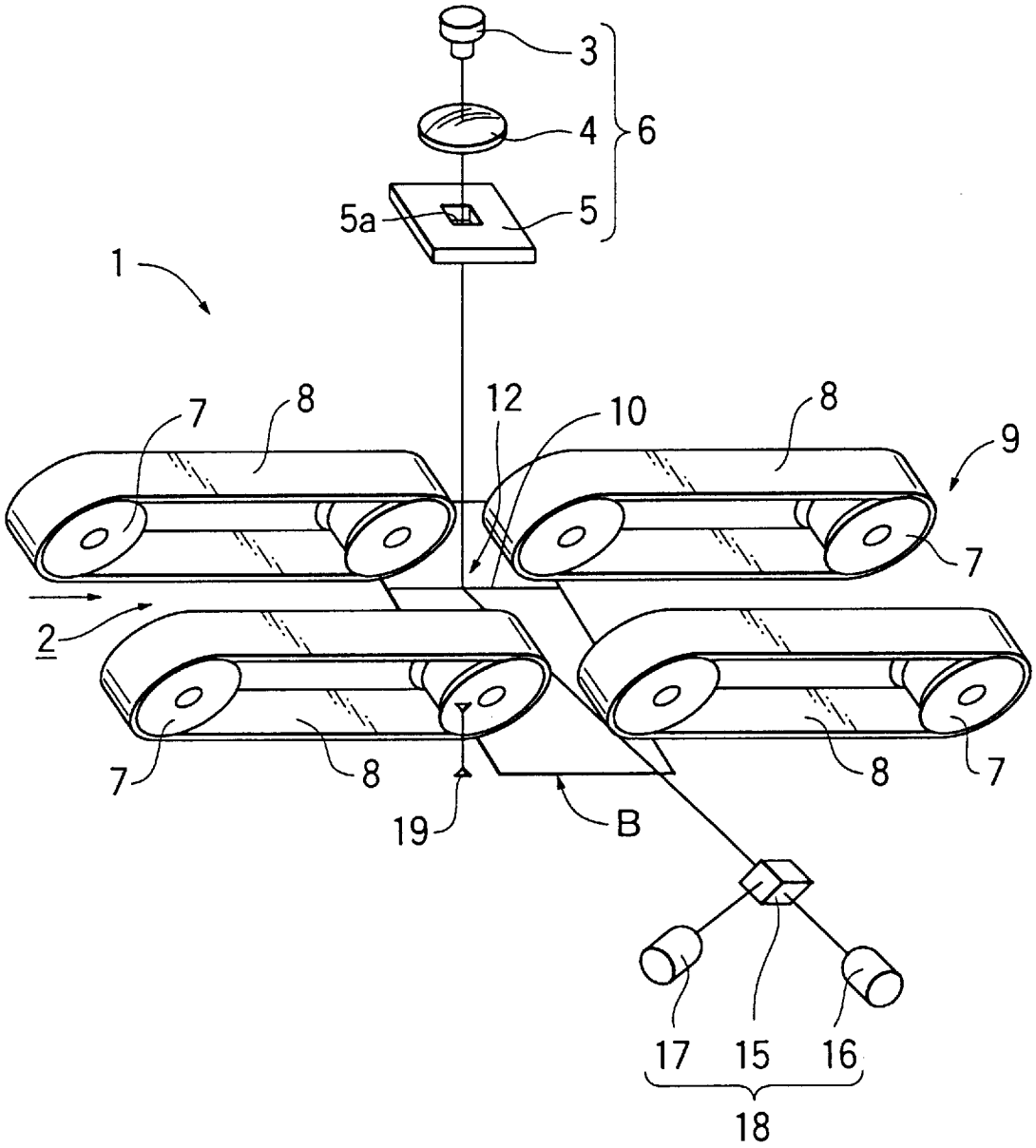
FIG. 1 is a schematic perspective view of a bill discriminating apparatus which is an embodiment of the present invention.

As shown in FIG. 1, a bill discriminating apparatus 1 is provided above a bill transport passage 2 in which bills are transported with an irradiating device 6 including a light source 3 for emitting light toward a security thread provided in a bill B, a collimator lens 4 for transforming light emitted from the light source 3 to parallel light and a slit plate 5 formed with a slit 5*a*. In this embodiment, a halogen lamp is used as the light source 3.

Figure 2:
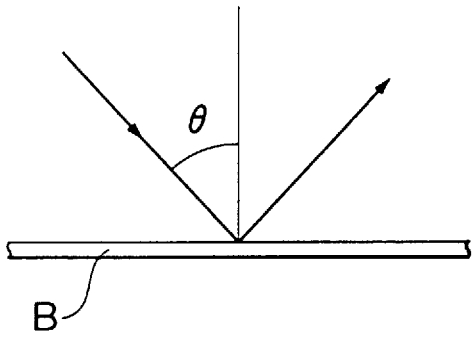
FIG. 2 is a schematic view showing how light emitted from a light source impinges on a bill and is reflected therefrom.

In FIG. 1, the bill B is transported by a transporting device 9 including a plurality of transporting means each including a pair of pulleys 7 and an endless belt 8 with the longer edge thereof aligned perpendicularly to the transport direction. A security thread 10 made of resin or metal is embedded in the bill on one of the surfaces thereof to lie parallel to the shorter edge of the bill. The light source 3, the collimator lens 4 and the slit plate 5 are disposed in such a manner that, as shown in FIG. 2, light impinges on the bill B at an angle θ with respect to the direction perpendicular to the surface of the bill B. The angle θ is determined to be equal to or close to the polarizing angle of the material forming the security thread 10.

A polarization beam splitter 15 is provided at a position where it can receive light emitted from the light source 3 toward the bill being transported by the transporting device 9 and reflected by the security thread 10 of the bill B. The polarization beam splitter 15 is shaped to be cubic by adhering a pair of rectangular prisms and receives light reflected by the security thread 10 of the bill B and separates it into the P-polarized light and the S-polarized light. A light receiving device 18 is formed by the polarization beam splitter 15, a first photosensor 16 for receiving the P-polarized light separated by the polarization beam splitter 15 and a second photosensor 17 for receiving the S-polarized light separated by the polarization beam splitter 15. The first photosensor 16 and the second photosensor 17 are disposed to be equally spaced from the surfaces of the polarization beam splitter 15 from which the P-polarized light and the S-polarized light emit so that the intensities of the P-polarized light and the S-polarized light received by the first photosensor 16 and the second photosensor 17 are equal to each other.

Further, a photosensor 19 is provided immediately upstream of a discriminating section 12 where light is emitted from the light source toward the bill B for detecting bills B and when the photosensor 19 detects a bill B, a detection signal is output to a CPU described later.

In this embodiment, bills B are fed to the bill discriminating apparatus 1 in such a manner that the surfaces thereof on which the security threads 10 are provided are faced up and that the upper edges thereof are oriented in a predetermined direction, thereby ensuring that the security threads 10 provided in the bills pass through the same position in the bill discriminating apparatus 1.

Figure 3:
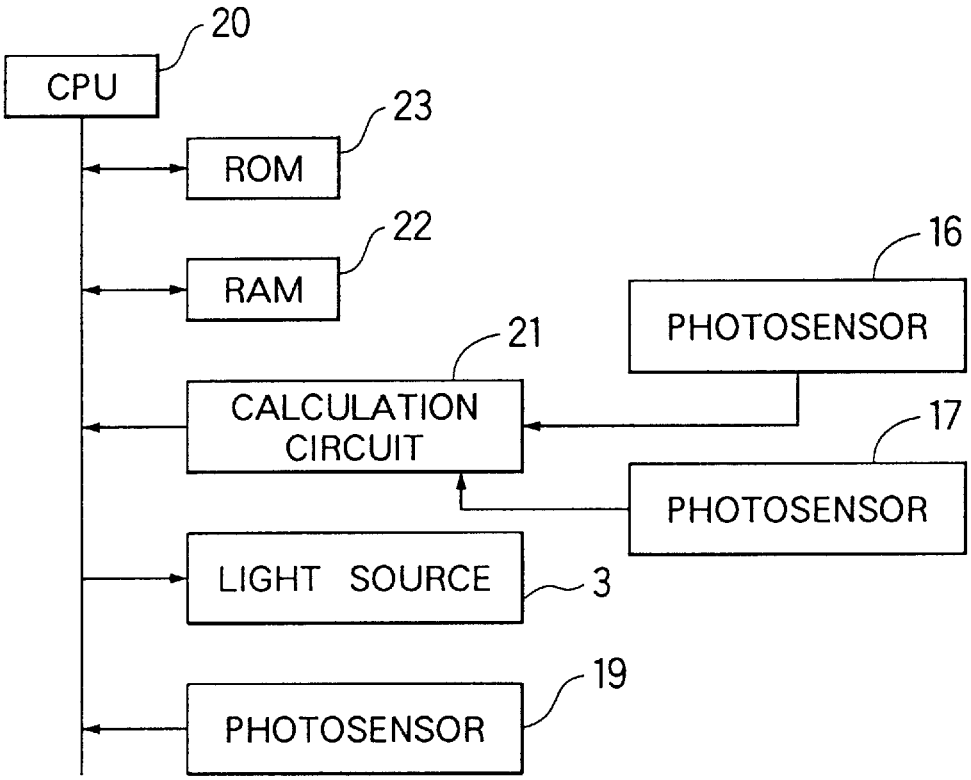
FIG. 3 is a block diagram of a detection system and a control system of a discriminating apparatus.

FIG. 3 is a block diagram of a detection system and a control system of the bill discriminating apparatus 1.

As shown in FIG. 3, the detection system of the bill discriminating apparatus 1 includes the photosensor 19 provided immediately upstream of the discriminating section 12, the first photosensor 16 for photoelectrically detecting the P-polarized light separated by the polarization beam splitter 15 and the second photosensor 17 for photoelectrically detecting the P-polarized light separated by the polarization beam splitter 15.

The control system of the bill discriminating apparatus 1 includes a CPU 20, a calculation circuit 21 for calculating the ratio of the intensity of the P-polarized light to that of the S-polarized light based on detection signals input from the first photosensor 16 and the second photosensor 17 to produce detection data, a RAM 22 for storing the detection data produced by the calculation circuit 21, and a ROM 23 for storing reference data regarding the ratio of the intensity of the P-polarized light to that of the S-polarized light contained in light reflected from the security thread 10 provided in a genuine bill B. The CPU 20 reads the detection data produced by the calculation circuit 21 and stored in the RAM 22 and the reference data stored in the ROM 23 and compares them to discriminate the genuineness of the bill B. The CPU 20 is further constituted so as to turn the light source 3 on to cause it to emit light toward the bill B.

The thus constituted bill discriminating apparatus 1 discriminates bills in the following manner.

A bill is transported along the bill transport passage 2 by the transporting device 9 in such a manner that the surface thereof on which the security thread 10 is provided is faced up and that the upper edge thereof is oriented in a predetermined direction. When the photosensor 19 provided immediately upstream of the discriminating section 12 detects the bill B, a bill detection signal is output to the CPU 20. When the CPU 20 receives the bill detection signal from the photosensor 19, it turns the light source 3 on at the time the bill B reaches the discriminating section.

As a result, light is emitted from the light source 3 and is transformed by the collimator lens 4 to parallel light. Light then passes through the slit 5*a* to become a thin light beam and spot-like impinges on the security thread 10 provided in the bill B.

Light is reflected by the security thread 10 and received by the polarization beam splitter 15. The polarization beam splitter 15 separates the received light into the P-polarized light and the S-polarized light. The P-polarized light is photoelectrically detected by the first photosensor 16 and the S-polarized light is photoelectrically detected by the second photosensor 17, thereby generating electrical signals in accordance with the intensity of the received P-polarized light and the received S-polarized light.

The detection signals from the first photosensor 16 and the second photosensor 17 are input to the calculation circuit 21 and the calculation circuit 21 calculates the ratio of the intensity of the detected P-polarized light to that of the detected S-polarized light based on the input detection signals to produce detection data and outputs them to the RAM 22.

The CPU 20 reads the detection data from the RAM 22 and the reference data from the ROM 23 and compares them to discriminate the genuineness of the bill B in accordance with the presence or absence of the security thread 10, the material thereof and the position thereof.

Since the angle of light incident onto the security tread 10 is determined so that the angle θ with the direction perpendicular to the surface of the bill B is equal to or close to the polarization angle of the material forming the security thread 10, the amount of the P-polarized light component contained in light reflected by the security thread 10 is much less than that of the S-polarized light component and, therefore, the detection data of the genuine bill B produced by the calculation circuit 21 is much less than 1. On the other hand, since the polarization angle differs depending on the material forming the surface of light incidence, in the case where no security thread 10 is provided or where the security thread 10 is formed of a different material, since the angle of light incident onto the security tread 10 is determined so that the angle θ with the direction perpendicular to the surface of the bill B is equal to or close to the polarization angle of the material forming the security thread 10, the ratio of the amount of the P-polarized light component contained in reflected light to that of the S-polarized light component is greater than the ratio of the amount of the P-polarized light component contained in light reflected by the security thread 10 provided in the genuine bill B to that of the S-polarized light component and, therefore, the detection data produced by the calculation circuit 21 is closer to 1. Accordingly, it is possible to discriminate the genuineness of a bill B by comparing the detection data produced by the calculation circuit 21 with the reference data.

Further, since light emitted from the light source 3 passes through the slit 5*a*, thereby spot-like impinging on the security thread 10 and the ratio of the amount of the P-polarized light component contained in reflected light to that of the S-polarized light component, which is inherent to the material forming the surface, is calculated based on light reflected by a spot region having a small area, thereby discriminating the genuineness of a bill B, it is possible to discriminate the genuineness of a bill B with high accuracy even if the bill is damaged or wrinkled.

According to the above described embodiment, light emitted from the light source 3 spot-like impinges on the security thread 10 at an angle equal to or close to the polarization angle of the material forming the security thread provided in a genuine bill B and the ratio of the amount of the P-polarized light component contained in light reflected by the security thread 10 to that of the S-polarized light component is calculated to produce the detection data. The thus produced detection data are compared with the reference data regarding the ratio of the amount of the P-polarized light component contained in light reflected by the security thread 10 of a genuine bill B to that of the S-polarized light component, thereby discriminating the genuineness of the bill B. Therefore, even if bills are damaged or wrinkled, it is possible to discriminate the genuineness of bills B with high accuracy.

Figure 4:
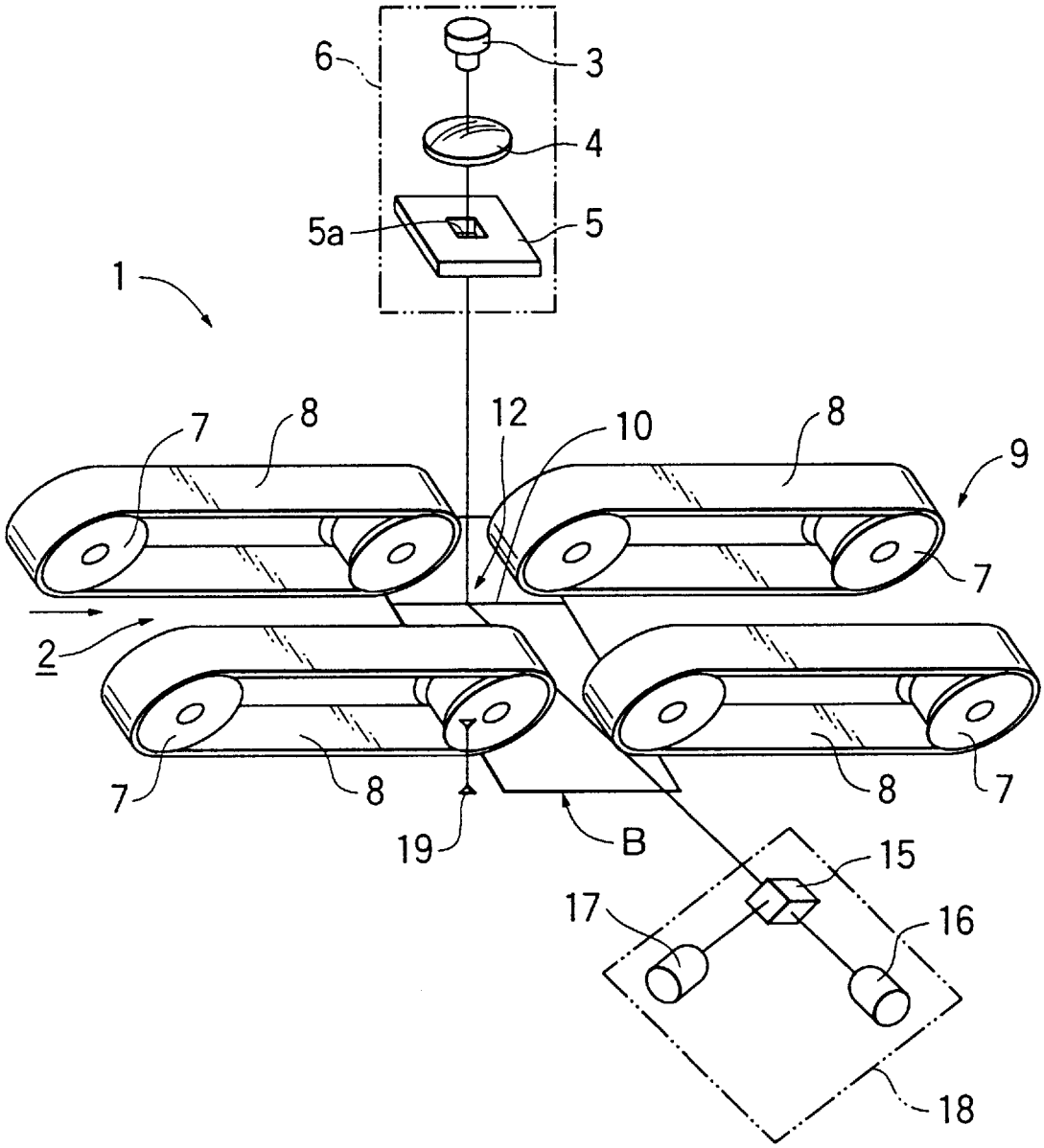
FIG. 4 is a schematic perspective view showing a bill discriminating apparatus which is another embodiment of the present invention.
Figure 5:
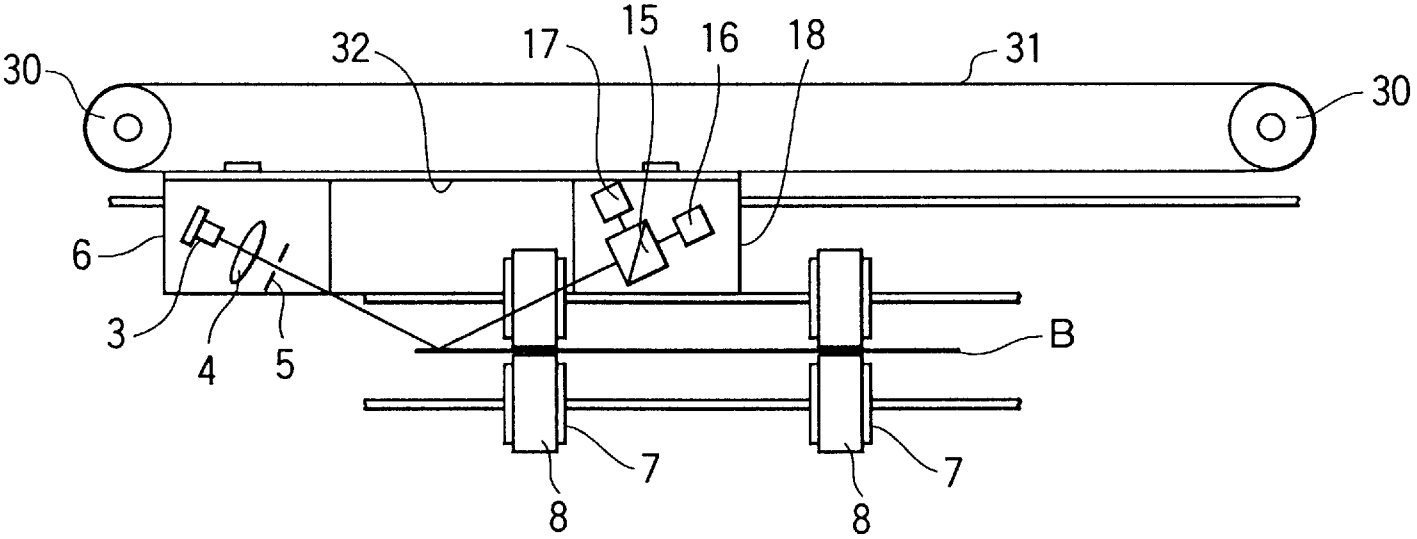
FIG. 5 is a schematic side view showing a bill discriminating apparatus which is another embodiment of the present invention.

FIG. 4 is a schematic side view showing a bill discriminating apparatus which is another embodiment of the present invention and FIG. 5 is a schematic side view thereof.

The bill discriminating apparatus 1 according to this embodiment is constituted so as to enable the discrimination of the genuineness of bills B fed thereto in such a manner that the surfaces of the bills B on which the security threads 10 are provided are faced up but that the upper edges of the bills B are not oriented in a predetermined direction. The security thread 10 is not provided at the center positions of bills B but is generally provided at position close to one of the shorter edge portions of bills B. Therefore, in the case where the irradiating device 6 and the light receiving device 18 are fixed, unless bills B are fed to the bill discriminating apparatus 1 in such a manner that the surfaces thereof on which the security threads 10 are provided are faced up and the upper edges thereof are oriented in a predetermined direction, it is impossible to discriminate the genuineness of bills B based on light reflected by the security threads 10. In view of this, in this embodiment, the irradiating device 6 is formed as an integral unit and the light receiving device 18 is also formed as an integral unit and the irradiating device 6 and the light receiving device 18 are made synchronously movable.

As shown in FIG. 5, the bill discriminating apparatus 1 further includes a pair of drive pulleys 30, 30 and a connecting wire 31 wound around the pair of drive pulleys 30, 30 and the irradiating device 6, and the light receiving device 18 are mounted on a mounting unit 32 connected to the connecting wire 31. Therefore, the irradiating device 6 and the light receiving device 18 can be moved from the upper portion to the lower portion in FIG. 4 by rotating the drive pulleys 30, 30 counterclockwise in FIG. 5. The drive speed of the drive pulleys 30, 30 is determined so as to move the irradiating device 6 and the light receiving device 18 while a bill B passes through the discriminating section 12 in such a manner that light emitted from the irradiating device 6 is moved from the upper end to the lower end of a bill B in FIG. 4.

The thus constituted bill discriminating apparatus 1 discriminates bills B in the following manner.

A bill B is transported along the bill transport passage 2 by the transporting device 9 in such a manner that the surface thereof on which the security thread 10 is provided is faced up and when the photosensor 19 provided immediately upstream of the discriminating section 12 detects the bill B, a bill detection signal is output to the CPU 20. When the CPU 20 receives the bill detection signal from the photosensor 19, it turns on the light source 3 at the time the bill B reaches the discriminating section 12 and simultaneously rotates the drive pulleys 30, 30.

Figure 6:
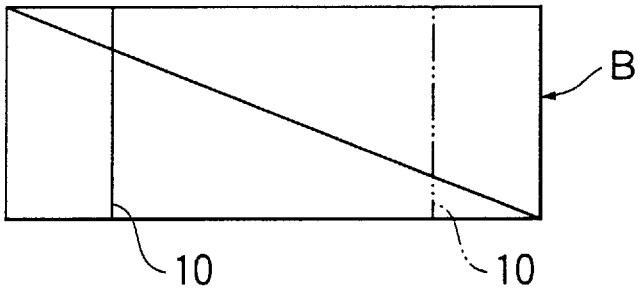
FIG. 6 is a schematic plan view of a bill showing a scanning line of light on the bill.

Thus, as the drive pulleys 30, 30 rotate, the irradiating device 6 and the light receiving device 18 are moved in the direction indicated by an arrow B, while the bill B is transported by the transporting device 9 in the direction indicated by an arrow A in FIG. 4. As a result, the surface of the bill B is scanned along a diagonal line thereof with light emitted from the light source 3 as shown in FIG. 6, and light reflected by the bill B is received by the light receiving device 18. The received light is separated by the polarization beam splitter 15 into the P-polarized light and the S-polarized light. The P-polarized light is photo-electrically detected by the photosensor 16 and the S-polarized light is photo-electrically detected by the photosensor 17.

The detection signals are input to the calculation circuit 21 from the photosensor 16 and the photosensor 17.

In this embodiment, since bills B are fed to the bill discriminating apparatus 1 in such a manner that the surfaces thereof on which the security threads 10 are provided are faced up, the security threads 10 can pass through the discriminating section 12 at two different positions. However, since these positions are known, the CPU 20 causes the calculation circuit 21 to calculate the ratio of intensity of the detected P-polarized light and the detected S-polarized light based on detection signals to produce detection data only when the photosensor 16 and the photosensor 17 detect light emitted from positions where the security threads 10 can exist and output the detection signals to the calculation circuit 21 which calculates the detection data and outputs them to the RAM 22.

The CPU 20 reads the detection data from the RAM 22 and also reads reference data from the ROM 23. The CPU 20 then compares the detection data with the reference data and discriminates the genuineness of the bill B in accordance with the presence or absence of the security thread 10, the material thereof and the position thereof.

When discrimination for one bill B has been completed, the CPU 20 rotates the drive pulleys 30, 30 in the reverse direction, thereby returning the irradiating device 6 and the light receiving device 18 to their original positions.

According to this embodiment, it is possible to discriminate bills B with high accuracy even when the bills B are fed to the bill discriminating apparatus 1 in such a manner that the surfaces thereof on which the security threads 10 are provided are faced up but that the upper edge portions or lower edge portions of the bills B are not oriented in a predetermined direction.

Figure 7:
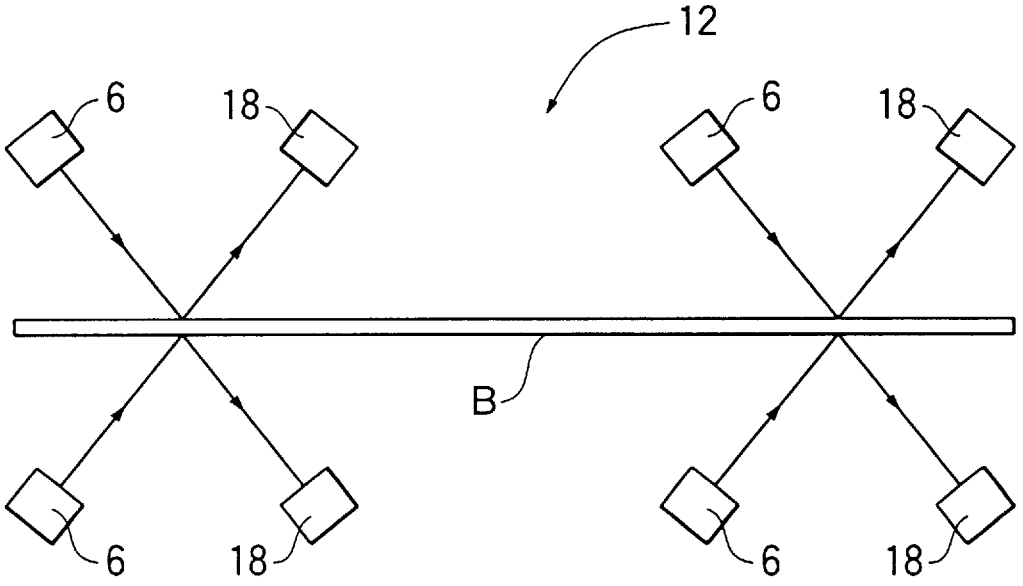
FIG. 7 is a schematic side view showing a bill discriminating apparatus which is a further embodiment of the present invention.

FIG. 7 is a schematic side view showing a bill discriminating apparatus 1 which is a further embodiment of the present invention.

As shown in FIG. 7, the bill discriminating apparatus 1 includes two pairs of the irradiating devices 6 and the light receiving devices 18 above the discriminating section 12 and two pairs of the irradiating devices 6 and the light receiving devices 18 below the discriminating section 12. In the case where bills B are fed to the bill discriminating apparatus 1 in such a manner that the obverse surfaces and the reverse surfaces of bills B may face either up or down and that the upper edge portions or lower edge portions of the bills B are not oriented in a predetermined direction, the security threads 10 can pass through the discriminating section 12 at four positions. Therefore, in such a case, it is required to detect light reflected by the four positions of a bill for discriminating the genuineness of the bill B based on the presence or absence of the security thread 10, the material thereof and the position thereof. Since this bill discriminating apparatus 1 includes four pairs of the irradiating devices 6 and the light receiving devices 18, it is possible to discriminate the genuineness even in such a case without moving each pair of the irradiating devices 6 and the light receiving devices 18.

The present invention has thus been shown and described with reference to specific embodiments. However, it should be noted that the present invention is in no way limited to the details of the described arrangements but changes and modifications may be made without departing from the scope of the appended claims.

For example, in the above described embodiments, the genuineness of a bill B is discriminated by irradiating the security thread 10 provided in the bill B, receiving light reflected by the security thread 10, separating the received light into the P-polarized light and the S-polarized light, photoelectrically detecting the P-polarized light and the S-polarized light, calculating the ratio of the P-polarized light component and the S-polarized light component contained in the reflected light to produce detection data and comparing the detection data with reference data. However, the present invention is not limited to the discrimination of bills B provided with the security threads 10 but can be applied to discriminate the genuineness of bills B formed with a hologram at a part thereof, bills B containing a fluorescent material at a part thereof, bills B having a print, with special ink at a part thereof or the like by irradiating the part of the bill B formed of the characteristic material, receiving light reflected by the part, separating the received light into the P-polarized light and the S-polarized light, photoelectrically detecting the P-polarized light and the S-polarized light, calculating the ratio of the P-polarized light component and the S-polarized light component contained in the reflected light to produce detection data and comparing the detection data with reference data.

Further, in the above described embodiments, although the genuineness of bills B is discriminated, the present invention is not limited to the discrimination of the genuineness of bills B but can be applied to discriminate securities or the like formed with the security thread.

Furthermore, in the above described embodiments, although a halogen lamp is used for the light source 3, the kind of the light source 3 is not limited and a laser beam source or other light source can be used.

Moreover, in the embodiment shown in FIGS. 4 and 5, when a bill B reaches the discriminating section 12, the light source 3 is turned on and the bill B is constantly irradiated with light during the passage thereof through the discriminating section 12. However, the genuineness of bills B may be discriminated by turning the light source 3 on only when the bill B reaches a position where light can project onto a portion of the bill B where the security thread 10 can exist, irradiating the bill with light, receiving light reflected by the security thread 10, separating the received light into the P-polarized light and the S-polarized light, photoelectrically detecting the P-polarized light and the S-20 polarized light, calculating the ratio of the P-polarized light component and the S-polarized light component contained in the reflected light to produce detection data and comparing the detection data with reference data.

Further, in the embodiment shown in FIGS. 4 and 5, although the irradiating device 6 and the light receiving device 18 are moved, instead, two pairs of the irradiating device 6 and the light receiving device 18 can be fixedly provided at positions where light can project onto a portion of the bill B where the security thread 10 can exist.

Furthermore, in the above described embodiments, although the genuineness of bills B is discriminated by obtaining the ratio of intensity of the P-polarized light component to that the S-polarized light component to produce detection data and comparing the detection data with reference data, the genuineness of bills B may be discriminated by obtaining the ratio of intensity of the S-polarized light component to that of the P-polarized light component to produce detection data and comparing the detection data with reference data, or obtaining the difference between the intensity of the P-polarized light component and that of the S-polarized light component to produce detection data and comparing the detection data with reference data.

Moreover, in the embodiment shown in FIGS. 4 and 5, although the drive speed of the drive pulleys 30, 30 is determined so as to move the irradiating device 6 and the light receiving device 18 while a bill B passes through the discriminating section 12 in such a manner that light emitted from the irradiating device 6 is moved from the upper end to the lower end of a bill B in FIG. 4, it is not absolutely necessary to determine the drive speed of the drive pulleys 30, 30 in such a manner but it is sufficient to determine the drive speed of the drive pulleys 30, 30 so that light emitted from the irradiating device 6 can be moved from the upper end to the lower end of a bill B in FIG. 4 during the passage of a bill B through the discriminating section 12.

Further, in the embodiment shown in FIGS. 4 and 5, although the irradiating device 6 and the light receiving device 18 are moved from the upper portion to the lower portion in FIG. 4, they may be moved from the lower portion to the upper portion in FIG. 4.

Furthermore, in this specification and the appended claims, the respective means need not necessarily be physical means and arrangements whereby the functions of the respective means are accomplished by software fall within the scope of the present invention. In addition, the function of a single means may be accomplished by two or more physical means and the functions of two or more means may be accomplished by a single physical means.

According to the present invention, it is possible to provide a bill or security discriminating apparatus for discriminating bills or securities with high accuracy even if they are damaged or wrinkled.

I claim:

1. A bill or security discriminating apparatus comprising at least one irradiating means for irradiating a surface of a bill or security at a predetermined angle with the surface thereof, at least one polarization separating means for receiving light emitted from the irradiating means and reflected by the surface of the bill or security and separating the received light into P-polarized light and S-polarized light, at least one first light receiving means for photoelectrically detecting the P-polarized light separated by the at least one polarization separating means and generating an electrical signal in accordance with intensity of the detected light, at least one second light receiving means for photoelectrically detecting the S-polarized light separated by the at least one polarization separating means and generating an electrical signal in accordance with intensity of the detected light, and discriminating means for discriminating the bill or security in accordance with the intensity of the P-polarized light and S-polarized light based on the electrical signals input from the at least one first light receiving means and the at least one second light receiving means.

2. A bill or security discriminating apparatus in accordance with claim 1 wherein the discriminating means further includes at least one calculating means for calculating a ratio of intensity of the P-polarized light to that of the S-polarized light, a ratio of intensity of the S-polarized light to that of the P-polarized light or a difference between the P-polarized light and that of the S-polarized light and is constituted so as to discriminate the bill or security in accordance with the ratio of intensity of the P-polarized light to that of the S-polarized light, the ratio of intensity of the S-polarized light to that of the P-polarized light or the difference between the P-polarized light and that of the S-polarized light calculated by the calculating means.

3. A bill or security discriminating apparatus in accordance with claim 1 wherein the predetermined angle is determined to be equal to or close to a polarizing angle of material forming the surface of the bill or security to be irradiated with light.

4. A bill or security discriminating apparatus in accordance with claim 2 wherein the predetermined angle is determined to be equal to or close to a polarizing angle of material forming the surface of the bill or security to be irradiated with light.

5. A bill or security discriminating apparatus in accordance with claim 1 wherein the irradiating means includes a light source, a collimator lens and a slit plate formed with a slit.

6. A bill or security discriminating apparatus in accordance with claim 2 wherein the irradiating means includes a light source, a collimator lens and a slit plate formed with a slit.

7. A bill or security discriminating apparatus in accordance with claim 3 wherein the irradiating means includes a light source, a collimator lens and a slit plate formed with a slit.

8. A bill or security discriminating apparatus in accordance with claim 4 wherein the irradiating means includes a light source, a collimator lens and a slit plate formed with a slit.

9. A bill or security discriminating apparatus in accordance with claim 1 wherein the at least one irradiating means, the at least one polarization separating means corresponding thereto, and the at least one first light receiving means and the at least one second light receiving means corresponding thereto are constituted so as to be synchronously movable.

10. A bill or security discriminating apparatus in accordance with claim 2 wherein the at least one irradiating means, the at least one polarization separating means corresponding thereto, and the at least one first light receiving means and the at least one second light receiving means corresponding thereto are constituted so as to be synchronously movable.

11. A bill or security discriminating apparatus in accordance with claim 2 wherein two of the irradiating means, the polarization separating means corresponding thereto, the first light receiving means and the second light receiving means corresponding thereto are respectively provided above and below the bill or security to be discriminated and four calculating means correspondingly are provided.

12. A bill or security discriminating apparatus in accordance with claim 3 wherein two of the irradiating means, the polarization separating means corresponding thereto, the first light receiving means and the second light receiving means corresponding thereto are respectively provided above and below the bill or security to be discriminated and four calculating means correspondingly are provided.

13. A bill or security discriminating apparatus in accordance with claim 3 wherein two of the irradiating means, the polarization separating means corresponding thereto, the first light receiving means and the second light receiving means corresponding thereto are respectively provided above and below the bill or security to be discriminated and four calculating means correspondingly are provided.

14. A bill or security discriminating apparatus in accordance with claim 4 wherein two of the irradiating means, the polarization separating means corresponding thereto, the first light receiving means and the second light receiving means corresponding thereto are respectively provided above and below the bill or security to be discriminated and four calculating means correspondingly are provided.

15. A bill or security discriminating apparatus in accordance with claim 5 wherein two of the irradiating means, the polarization separating means corresponding thereto, the first light receiving means and the second light receiving means corresponding thereto are respectively provided above and below the bill or security to be discriminated and four calculating means correspondingly are provided.

16. A bill or security discriminating apparatus in accordance with claim 6 wherein two of the irradiating means, the polarization separating means corresponding thereto, the first light receiving means and the second light receiving means corresponding thereto are respectively provided above and below the bill or security to be discriminated and four calculating means correspondingly are provided.

17. A bill or security discriminating apparatus in accordance with claim 7 wherein two of the irradiating means, the polarization separating means corresponding thereto, the first light receiving means and the second light receiving means corresponding thereto are respectively provided above and below the bill or security to be discriminated and four calculating means correspondingly are provided.

18. A bill or security discriminating apparatus in accordance with claim 8 wherein two of the irradiating means, the polarization separating means corresponding thereto, the first light receiving means and the second light receiving means corresponding thereto are respectively provided above and below the bill or security to be discriminated and four calculating means correspondingly are provided.

* * * * *